US011022328B2

(12) United States Patent
Koike et al.

(10) Patent No.: US 11,022,328 B2
(45) Date of Patent: Jun. 1, 2021

(54) HEAT SOURCE UNIT

(71) Applicant: DAIKIN INDUSTRIES, LTD., Osaka (JP)

(72) Inventors: Fumiaki Koike, Osaka (JP); Shigeki Kamitani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/094,840

(22) PCT Filed: Apr. 17, 2017

(86) PCT No.: PCT/JP2017/015450
§ 371 (c)(1),
(2) Date: Oct. 18, 2018

(87) PCT Pub. No.: WO2017/183601
PCT Pub. Date: Oct. 26, 2017

(65) Prior Publication Data

US 2019/0120506 A1 Apr. 25, 2019

(30) Foreign Application Priority Data

Apr. 21, 2016 (JP) ..... JP2016-084983

(51) Int. Cl.
*F24F 1/56* (2011.01)
*F24F 13/20* (2006.01)
*F24F 1/16* (2011.01)

(52) U.S. Cl.
CPC ..... *F24F 1/56* (2013.01); *F24F 1/16* (2013.01); *F24F 13/20* (2013.01)

(58) Field of Classification Search
CPC ..... F24F 1/10; F24F 1/16; F24F 1/46; F24F 1/56; F24F 13/20; F24F 2013/202;
(Continued)

(56) References Cited

U.S. PATENT DOCUMENTS 7,086,250 B2 * 8/2006 Ishihara ..... F24F 1/26 62/224
8,627,674 B2 * 1/2014 Platt ..... F24F 3/0442 62/259.1

(Continued)

FOREIGN PATENT DOCUMENTS

EP 3182029 A1 * 6/2017 ..... F24F 1/10
JP 2001-091023 A 4/2001

(Continued)

OTHER PUBLICATIONS

International Search Report issued in corresponding International Application No. PCT/JP2017/015450 dated Jul. 11, 2017, with translation (5 pages).

(Continued)

*Primary Examiner* — Jianying C Atkisson
*Assistant Examiner* — Miguel A Diaz
(74) *Attorney, Agent, or Firm* — Osha Bergman Watanabe & Burton LLP

(57) ABSTRACT

A heat source unit constitutes part of a basic refrigerant circuit including: a compressor that compresses refrigerant; an accumulator that temporarily accumulates the refrigerant before the refrigerant is sucked into the compressor; an oil separator that separates refrigerating machine oil from the refrigerant after the refrigerant has been discharged from the compressor; a heat source-side heat exchanger that functions as a radiator or an evaporator of the refrigerant; a liquid refrigerant communication pipe; utilization-side expansion valves; utilization-side heat exchangers; and a gas refrigerant communication pipe that are connected to one another, the heat source unit comprising refrigerant circuit constituent parts including the compressor, the accumulator, the oil separator, and the heat source-side heat exchanger that are provided inside a casing, and the refrigerant circuit constitu- (Continued)

ent parts being changed or added in accordance with capacity or function.

9 Claims, 7 Drawing Sheets

(58) Field of Classification Search
CPC ..... F24F 2013/205; F24F 1/68; F25B 6/00; F25B 6/02; F25B 6/04
See application file for complete search history.

(56) References Cited

U.S. PATENT DOCUMENTS 9,541,323 B2 * 1/2017 Kagawa ..... F25D 21/00
9,964,330 B2 * 5/2018 Son ..... F24F 13/20
10,041,704 B2 * 8/2018 Lee ..... F24F 13/22
10,378,782 B2 * 8/2019 Kamiaka ..... F24F 1/56
2005/0150247 A1 * 7/2005 Ishihara ..... F24F 1/26 62/507
2007/0163295 A1 * 7/2007 Martin, Sr. ..... F24F 1/08 62/507
2009/0107161 A1 * 4/2009 Jang ..... F24F 1/26 62/259.1
2009/0241577 A1 * 10/2009 Fukushima ..... F25B 13/00 62/259.1
2010/0031686 A1 * 2/2010 Platt ..... F24F 3/0442 62/259.1
2010/0175407 A1 * 7/2010 Kim ..... F04D 29/541 62/285
2011/0303396 A1 * 12/2011 Ishida ..... F24F 1/16 165/121
2014/0131024 A1 * 5/2014 Iwazaki ..... F24F 13/222 165/185
2014/0224457 A1 * 8/2014 Suzuki ..... F24F 1/16 165/121
2014/0338384 A1 * 11/2014 Koike ..... F24F 13/222 62/285
2015/0000321 A1 * 1/2015 Kagawa ..... F25D 21/00 62/291
2015/0040609 A1 * 2/2015 Yamauchi ..... F24F 1/58 62/508
2015/0111488 A1 * 4/2015 Son ..... F24F 3/044 454/329
2015/0184872 A1 * 7/2015 Oh ..... F24F 1/56 165/122
2015/0198353 A1 * 7/2015 Platt ..... F24F 13/32 62/298
2016/0131390 A1 * 5/2016 Kwon ..... F24F 13/30 138/155
2016/0178290 A1 * 6/2016 Lim ..... F28F 9/001 165/121
2017/0059189 A1 * 3/2017 Lim ..... F24F 1/32
2017/0115013 A1 * 4/2017 Kim ..... F24F 1/24
2017/0248342 A1 * 8/2017 Joseph ..... F24F 13/32
2017/0328582 A1 * 11/2017 Okuda ..... F02M 21/023
2018/0080667 A1 * 3/2018 Nishimoto ..... F25B 1/00
2018/0245805 A1 * 8/2018 Kamiaka ..... F24F 1/22
2019/0072285 A1 * 3/2019 Morikawa ..... F24F 1/56
2019/0219309 A1 * 7/2019 Nagashima ..... F25B 1/005
2019/0338985 A1 * 11/2019 Koike ..... F24F 1/56

FOREIGN PATENT DOCUMENTS

JP 2004-028359 A 1/2004
JP 2004-156799 A 6/2004
JP 2007-093151 A 4/2007
JP 2008-075974 A 4/2008
JP 2011-158137 A 8/2011
JP 2013-083422 A 5/2013
JP 2016-038175 A 3/2016
JP 2018063097 A * 4/2018 ..... F24F 1/46
WO WO-2011099629 A1 * 8/2011 ..... F24F 1/18
WO WO-2012141198 A1 * 10/2012 ..... F24F 1/22

OTHER PUBLICATIONS

Notification of Reasons for Refusal issued in corresponding Japanese Patent Application No. 2016-084983 dated Jun. 28, 2017, with translation (7 pages).
Extended European Search Report in counterpart European Application No. 17785939.4 dated Mar. 21, 2019 (7 pages).
Notification of Transmittal of Translation of the International Preliminary Report on Patentability for International Application No. PCT/JP2017/015450 dated Nov. 1, 2018 (1 page).
International Preliminary Report on Patentability issued in corresponding International Application No. PCT/JP2017/015450 dated Oct. 23, 2018 (7 pages).

* cited by examiner

HEAT SOURCE UNIT

TECHNICAL FIELD

The present invention relates to a heat source unit, and particularly a heat source unit where refrigerant circuit constituent parts are provided inside a casing.

BACKGROUND ART

Conventionally, there is an air conditioning system configured as a result of a heat source unit and a utilization unit being connected by pipes. In the heat source unit configuring this kind of air conditioning system, refrigerant circuit constituent parts are provided inside a casing, such as described in patent document 1 (JP-A No. 2011-158137). Here, a bottom frame forming a bottom surface of the casing has a structure divided in the front and rear direction.

SUMMARY

In the conventional heat source unit, when refrigerant circuit constituent parts are to be changed or added in accordance with capacity or function, questions such as on which of the divided bottom frames are the refrigerant circuit constituent parts that are to be changed or added to be provided, and which bottom frame is to be increased in size in order to provide the refrigerant circuit constituent parts that are to be changed or added, are not considered. That is, the placement of all the refrigerant circuit constituent parts including the refrigerant circuit constituent parts that are to be changed or added is reviewed and, on the basis of the results of the review, a change in the placement of the refrigerant circuit constituent parts and/or the size of the casing is executed.

However, with this approach, each time the refrigerant circuit constituent parts are changed or added in accordance with capacity or function, it is necessary to review the placement of all the refrigerant circuit constituent parts including the refrigerant circuit constituent parts that are to be changed or added, and deciding on the placement of the refrigerant circuit constituent parts to be changed or added and/or changing the size of the casing cannot be easily executed.

One or more embodiments of the present invention ensure that, in a heat source unit where refrigerant circuit constituent parts are provided inside a casing, when the refrigerant circuit constituent parts are changed or added in accordance with capacity or function, changing the size of the casing and placing the refrigerant circuit constituent parts can be easily executed.

A heat source unit according to one or more embodiments is a heat source unit where refrigerant circuit constituent parts are provided inside a casing and where the refrigerant circuit constituent parts are changed or added in accordance with capacity or function. Additionally, here, a bottom frame forming a bottom surface of the casing has a first bottom frame, on which are provided first refrigerant circuit constituent parts that are common regardless of capacity or function among the refrigerant circuit constituent parts, and a second bottom frame, on which are provided second refrigerant circuit constituent parts that are changed or added depending on capacity or function among the refrigerant circuit constituent parts.

Here, the bottom frame is divided in two, and the refrigerant circuit constituent parts that are common regardless of capacity or function (the first refrigerant circuit constituent parts) are provided on one bottom frame (the first bottom frame), so the placement of the refrigerant circuit constituent parts and the size of the casing on the first bottom frame side can be spared from being changed, regardless of whether or not the refrigerant circuit constituent parts are changed or added in accordance with capacity or function. Moreover, the refrigerant circuit constituent parts that are changed or added depending on capacity or function (the second refrigerant constituent circuit parts) are provided on the other bottom frame (the second bottom frame), so it suffices to change just the placement of the refrigerant circuit constituent parts and/or the size of the casing on the second bottom frame side.

Because of this, here, when the size of the casing is changed as a result of the refrigerant circuit constituent parts being changed or added in accordance with capacity or function, changing the size of the casing and placing the refrigerant circuit constituent parts can be easily executed.

A heat source unit according to one or more embodiments is the heat source unit of aforementioned embodiments, wherein the first refrigerant circuit constituent parts include a compressor that compresses refrigerant, an accumulator that temporarily accumulates the refrigerant before the refrigerant is sucked into the compressor, and an oil separator that separates refrigerating machine oil from the refrigerant after the refrigerant has been discharged from the compressor.

In the heat source unit, there is the concern that refrigerant pipes connected to the compressor and area devices (the compressor, the accumulator, and the oil separator) will sustain damage from vibrations during operation and during transport, so to ensure that such damage does not occur, the placement of these devices and the placement and shapes of the refrigerant pipes connected to these devices are appropriately set. For this reason, even in a case where the refrigerant circuit constituent parts are changed or added in accordance with capacity or function, the placement of these devices and the placement and shapes of the refrigerant pipes connected to these devices should be spared from being changed.

Therefore, here, the compressor and area devices (the compressor, the accumulator, and the oil separator) are collectively placed as the first refrigerant circuit constituent parts on the first bottom frame.

Because of this, here, even in a case where the refrigerant circuit constituent parts are changed or added in accordance with capacity or function, the compressor, the accumulator, and the oil separator and the placement and shapes of the refrigerant pipes connected to these devices can be spared from being changed.

A heat source unit according to one or more embodiments is the heat source unit of the aforementioned embodiments, wherein the first bottom frame has a larger plate thickness than the second bottom frame.

There are cases where the refrigerant circuit constituent parts that are common regardless of capacity or function (the first refrigerant circuit constituent parts) include heavy parts (e.g., the compressor and the accumulator) and where the refrigerant circuit constituent parts that are changed or added in accordance with capacity or function (the second refrigerant circuit constituent parts) include only light parts.

Therefore, here, the first bottom frame is configured to have a larger plate thickness than the second bottom frame.

Because of this, here, the strength of the first bottom frame can be increased and the weight of the second bottom frame can be reduced.

A heat source unit according to one or more embodiments is the heat source unit of the aforementioned embodiments, wherein the second refrigerant circuit constituent parts include a heat source-side heat exchanger that functions as a radiator or an evaporator of refrigerant, and the heat source-side heat exchanger is provided extending across both the first bottom frame and the second bottom frame.

In the heat source unit, the heat source-side heat exchanger is provided along an edge portion of the bottom frame, so by changing the length of the edge portion of the bottom frame, the size of the heat source-side heat exchanger can also be changed.

Therefore, here, the heat source-side heat exchanger is configured to serve as a second refrigerant circuit constituent part, and the heat source-side heat exchanger is provided extending across both the first bottom frame and the second bottom frame.

Because of this, here, by changing the size of the second bottom frame, the size of the heat source-side heat exchanger can be easily changed without changing the size of the first bottom frame.

A heat source unit of aforementioned embodiments is the heat source unit of the aforementioned embodiments, wherein the first bottom frame and the second bottom frame are corrugated plate-like members in which ridge portions and furrow portions extending across the front and rear direction of the casing are formed.

Here, the first bottom frame and the second bottom frame are configured to be corrugated plate-like members, so a high-strength bottom frame can be obtained. Moreover, here, the ridge portions and the furrow portions of the corrugated plate-like first bottom frame and second bottom frame are formed extending across the front and rear direction of the casing, so the first bottom frame and the second bottom frame can be placed side by side to the left and right of each other, when the casing is viewed from the front surface side, to change the size of the casing. It will be noted that although there are many cases where, when installing the heat source unit, there are restrictions on the size of the casing in the front and rear direction, here, the first bottom frame and the second bottom frame can be placed side by side to the left and right of each other to change the size of the casing, so the heat source unit can be spared from being subjected to restrictions on the size of the casing in the front and rear direction.

DETAILED DESCRIPTION OF EMBODIMENTS

Embodiments of a heat source unit and example modifications thereof will be described below on the basis of the drawings. It will be noted that the specific configurations of the heat source unit are not limited to those in the following embodiments and the example modifications thereof and can be changed in a range that does not depart from the spirit of the invention.

(1) Configuration of Air Conditioning System

Figure 1:
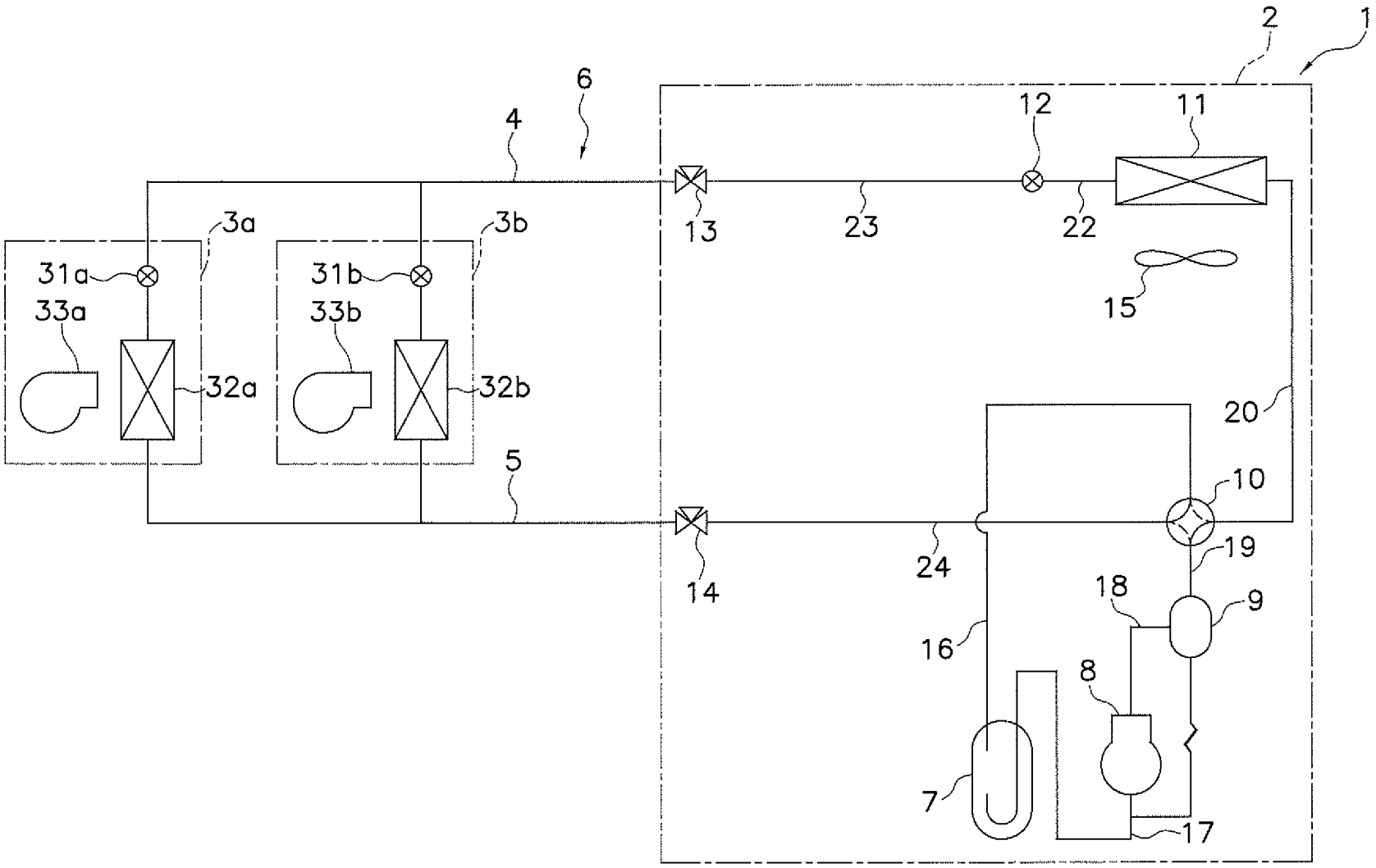
FIG. 1 is a general configuration diagram of an air conditioning system in which a heat source unit according to one or more embodiments of the invention is employed.

FIG. 1 is a general configuration diagram of an air conditioning system 1 in which a heat source unit 2 according to one or more embodiments of the invention is employed.

The air conditioning system 1 is a system that can execute cooling and heating of rooms in a building, for example, by executing a vapor compression refrigeration cycle. The air conditioning system 1 is configured as a result of mainly the heat source unit 2 and utilization units 3*a* and 3*b* being connected. Here, the heat source unit 2 and the utilization units 3*a* and 3*b* are connected via a liquid refrigerant communication pipe 4 and a gas refrigerant communication pipe 5. That is, a vapor compression refrigerant circuit 6 of the air conditioning system 1 is configured as a result of the heat source unit 2 and the utilization units 3*a* and 3*b* being connected via the refrigerant communication pipes 4 and 5.

The heat source unit 2 is installed outdoors (e.g., on the roof of the building or adjacent to a wall surface of the building) and configures part of the refrigerant circuit 6. The heat source unit 2 mainly has an accumulator 7, a compressor 8, an oil separator 9, a four-port switching valve 10, a heat source-side heat exchanger 11, a heat source-side expansion valve 12, a liquid-side stop valve 13, a gas-side stop valve 14, and a heat source-side fan 15. The devices and valves are connected to each other by refrigerant pipes 16 to 24.

The utilization units 3*a* and 3*b* are installed in rooms (e.g., living rooms or spaces on the reverse sides of ceilings) and configure part of the refrigerant circuit 6. The utilization unit 3*a* mainly has a utilization-side expansion valve 31*a*, a utilization-side heat exchanger 32*a*, and a utilization-side fan 33*a*. The utilization unit 3*b* mainly has a utilization-side expansion valve 31*b*, a utilization-side heat exchanger 32*b*, and a utilization-side fan 33*b*.

The refrigerant communication pipes 4 and 5 are refrigerant pipes constructed on site when installing the air conditioning system 1 in an installation location such as a building. One end of the liquid refrigerant communication pipe 4 is connected to the liquid-side stop valve 13 of the heat source unit 2, and the other end of the liquid refrigerant communication pipe 4 is connected to liquid-side ends of the utilization-side expansion valves 31*a* and 31*b* of the utilization units 3*a* and 3*b*. One end of the gas refrigerant communication pipe 5 is connected to the gas-side stop valve 14 of the heat source unit 2, and the other end of the gas refrigerant communication pipe 5 is connected to gas-side ends of the utilization-side heat exchangers 32*a* and 32*b* of the utilization units 3*a* and 3*b*.

(2) Configuration of Heat Source Unit

Figure 2:
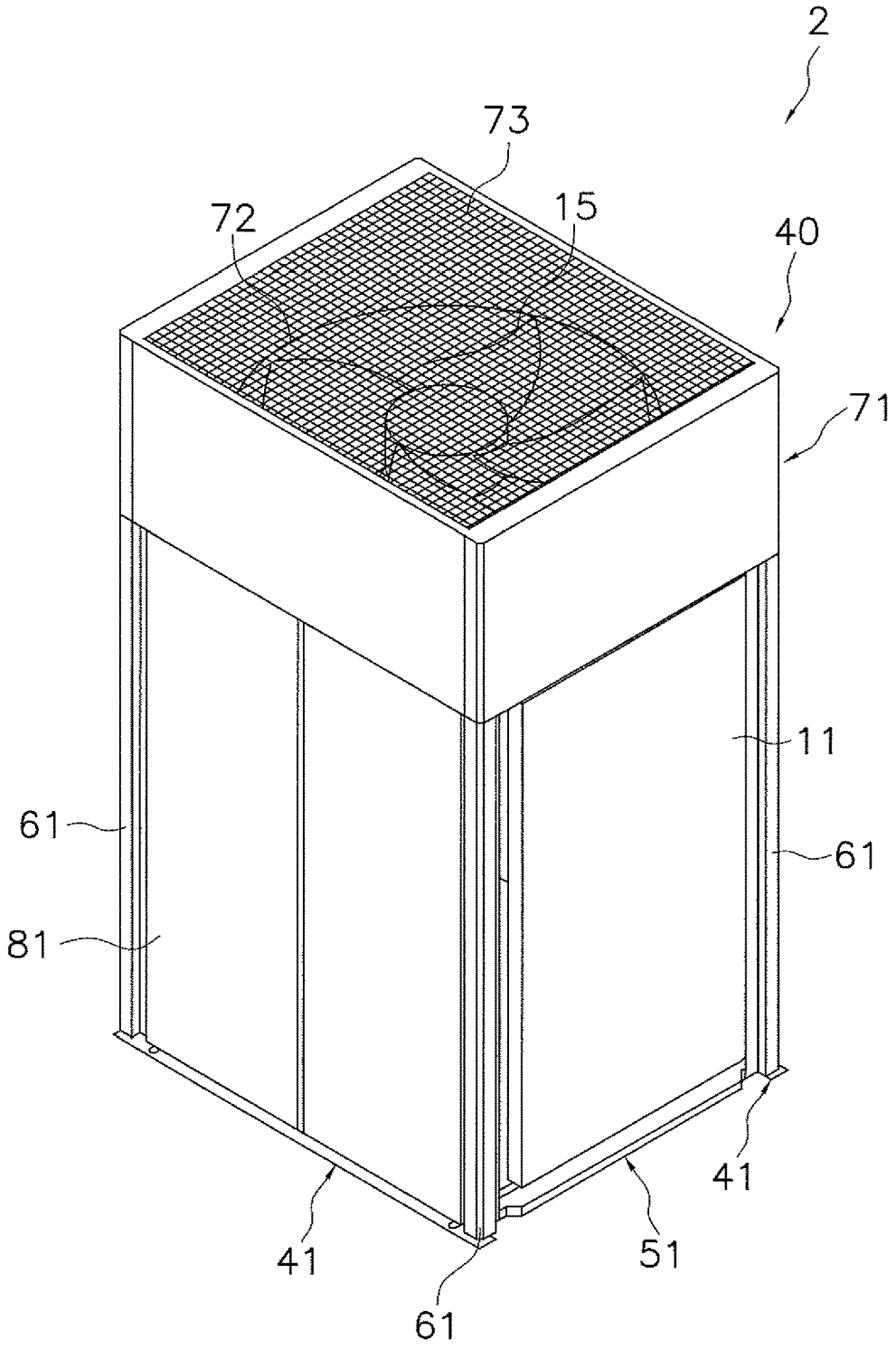
FIG. 2 is an external perspective view of the heat source unit according to one or more embodiments.
Figure 3:
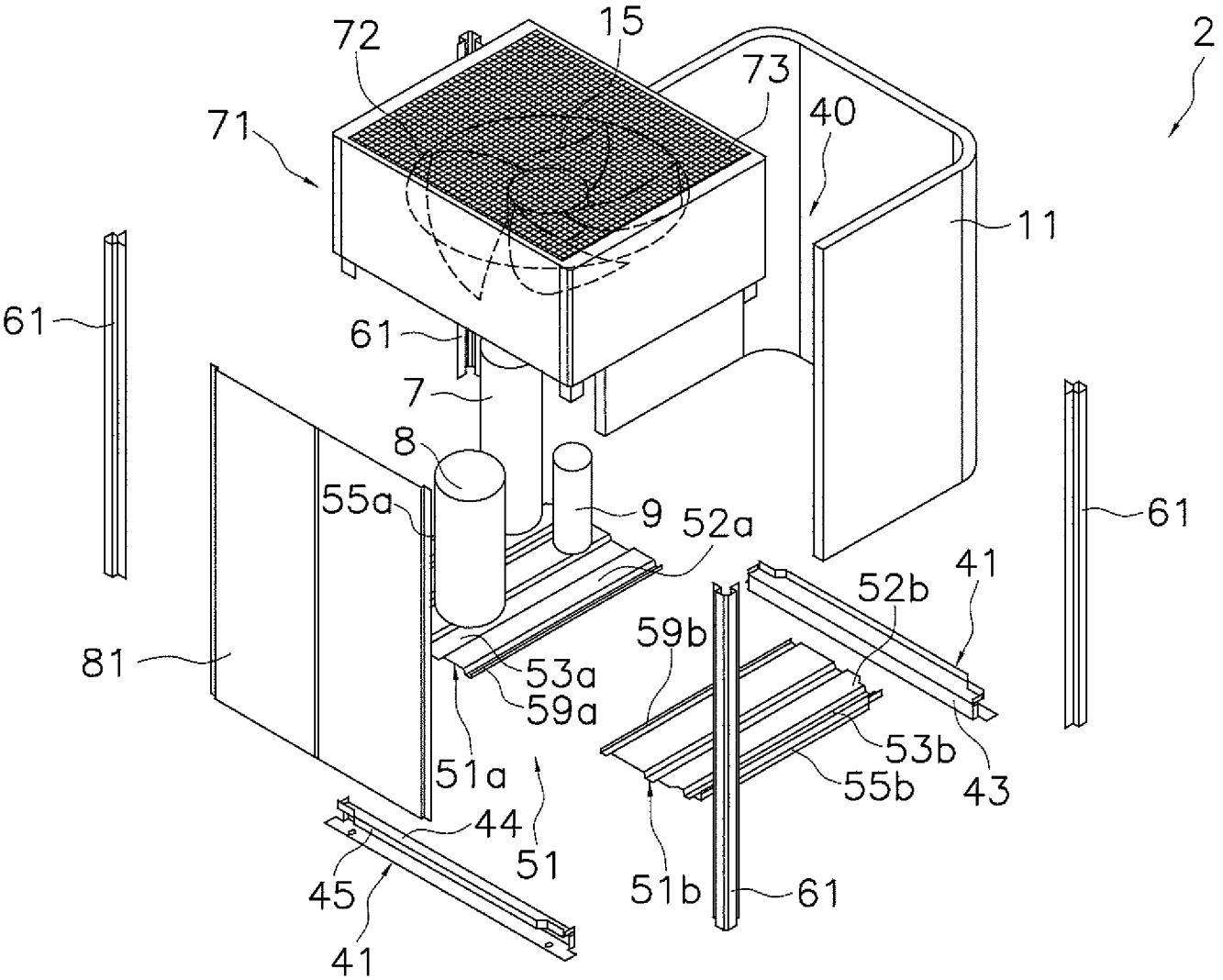
FIG. 3 is an exploded perspective view of the heat source unit (showing only the general shapes of an accumulator, a compressor, an oil separator, and a heat source-side heat exchanger) according to one or more embodiments.
Figure 4:
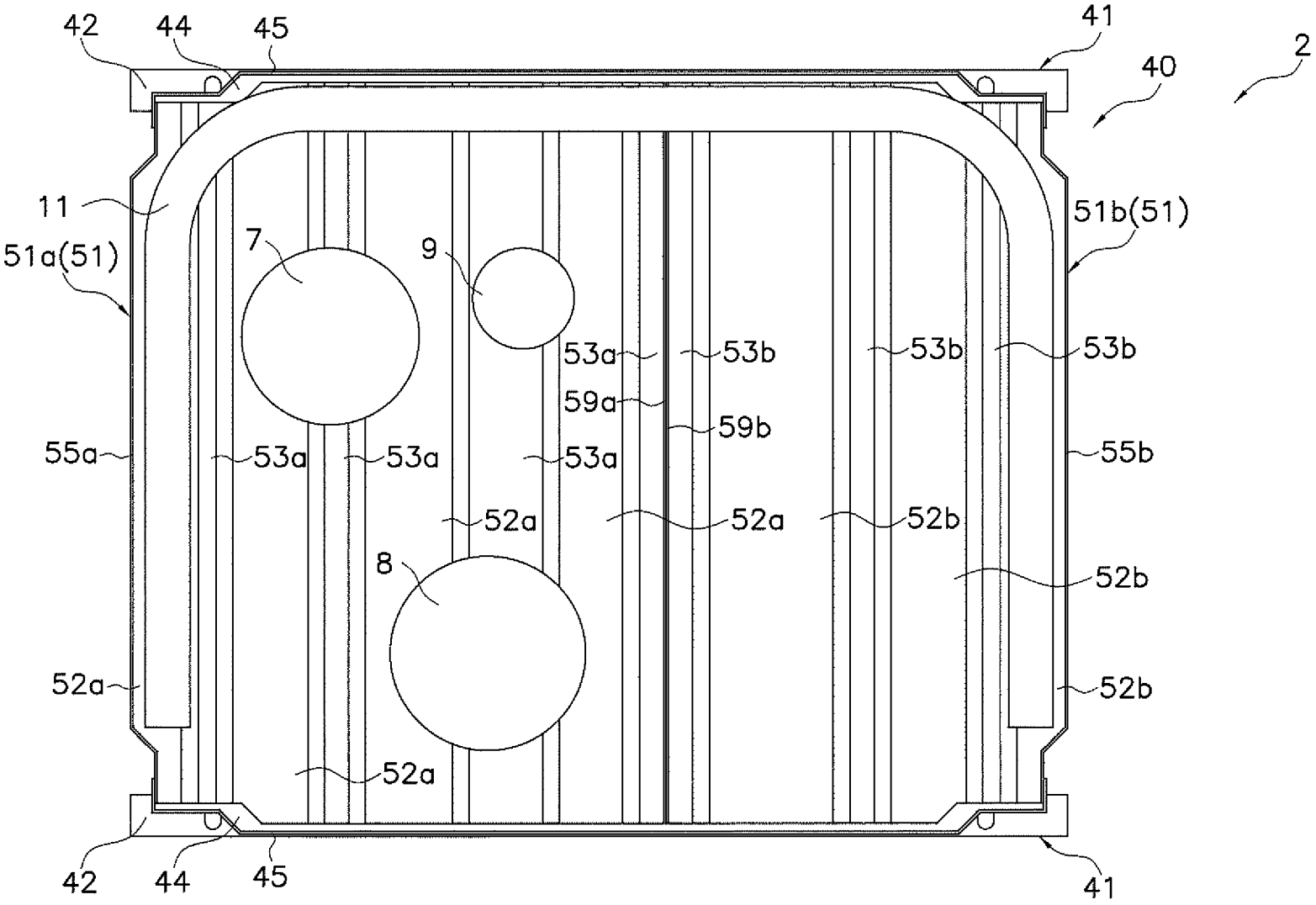
FIG. 4 is a plan view showing a bottom frame and mounting feet (showing only the general shapes of the accumulator, the compressor, the oil separator, and the heat source-side heat exchanger) according to one or more embodiments.
Figure 5:
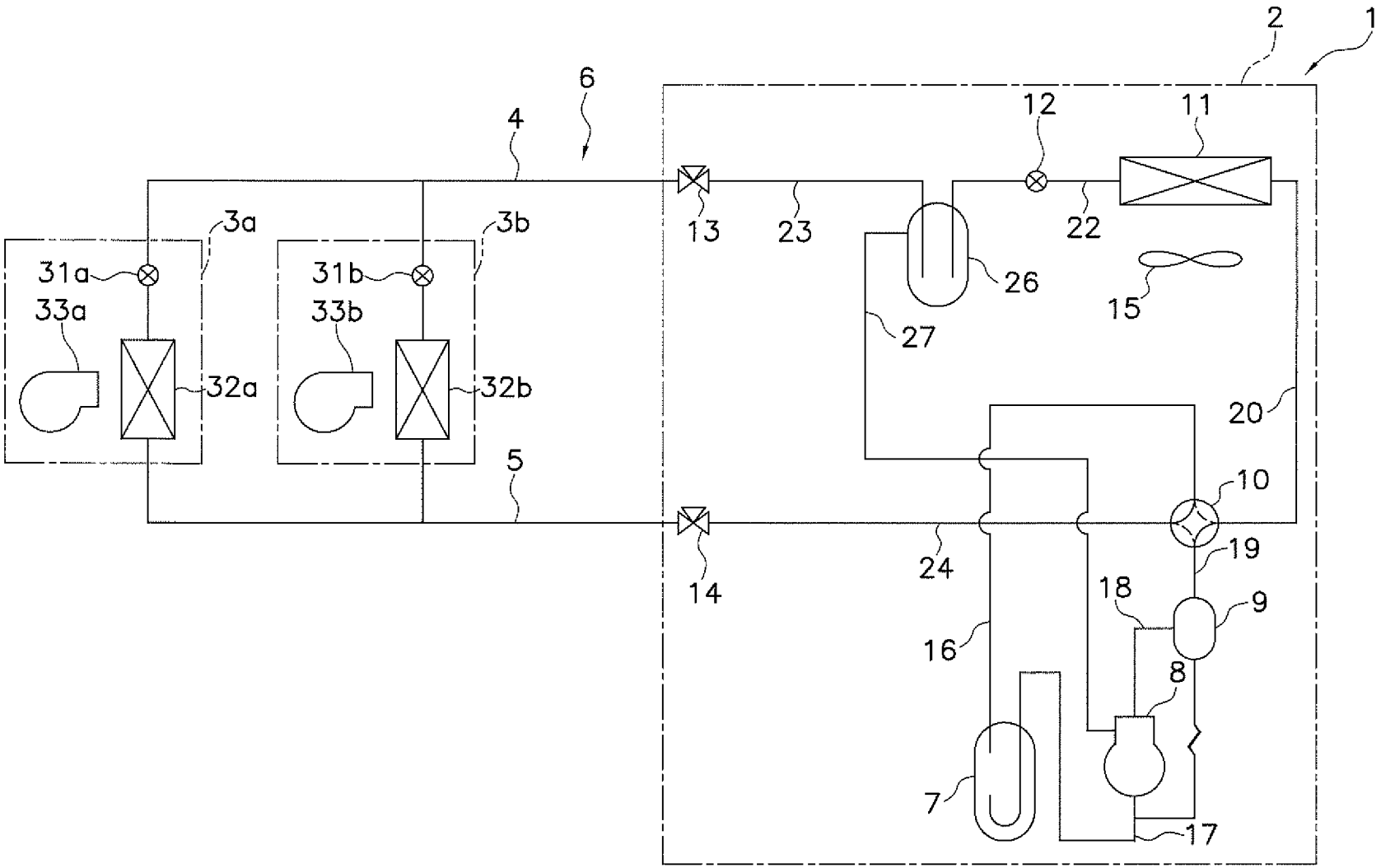
FIG. 5 is a general configuration diagram of the air conditioning system (in a case where an injection function has been added) according to one or more embodiments.
Figure 6:
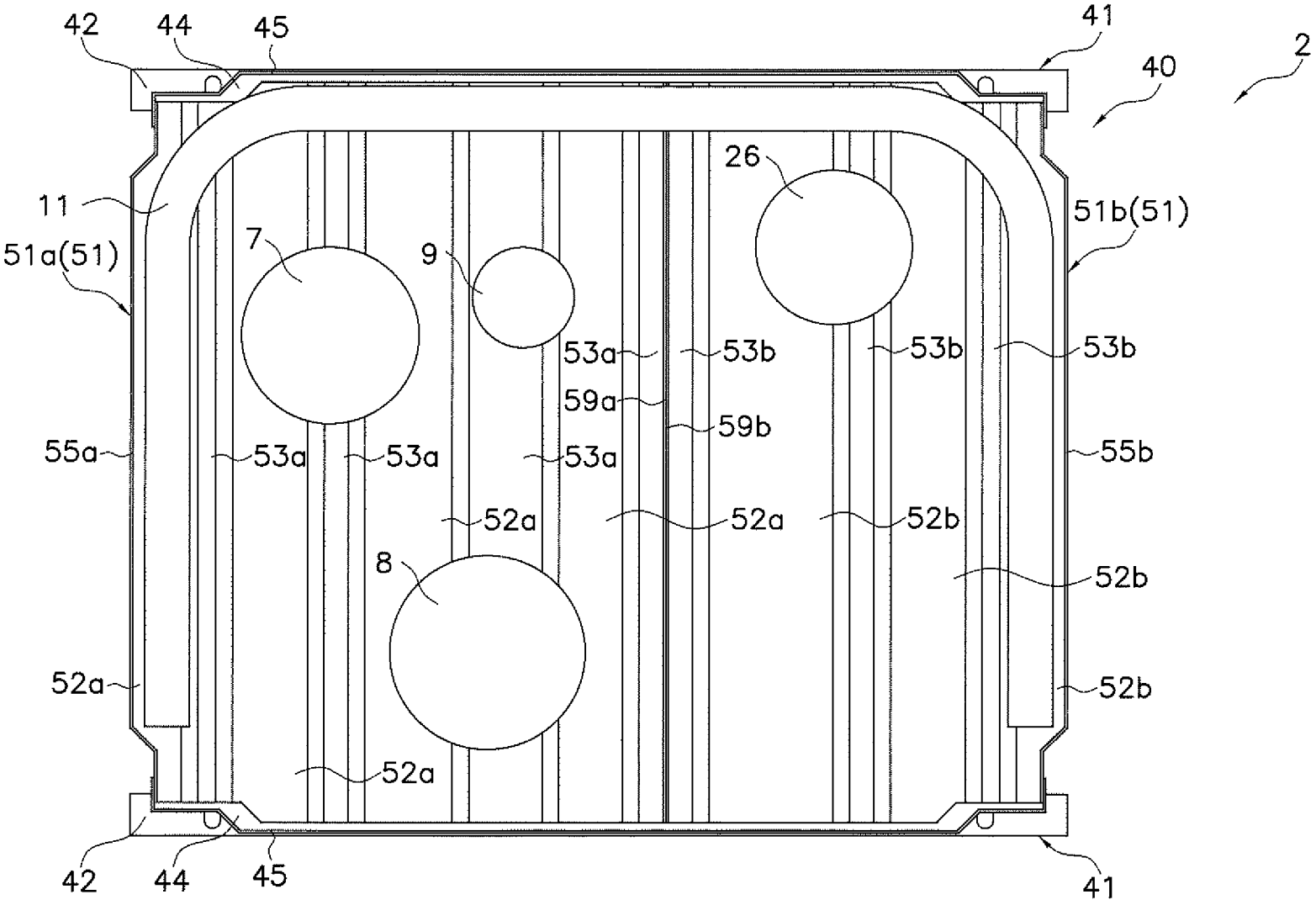
FIG. 6 is a plan view showing the bottom frame and the mounting feet in a case where the injection function has been added (showing only the general shapes of the accumulator, the compressor, the oil separator, the heat source-side heat exchanger, and a receiver) according to one or more embodiments.
Figure 7:
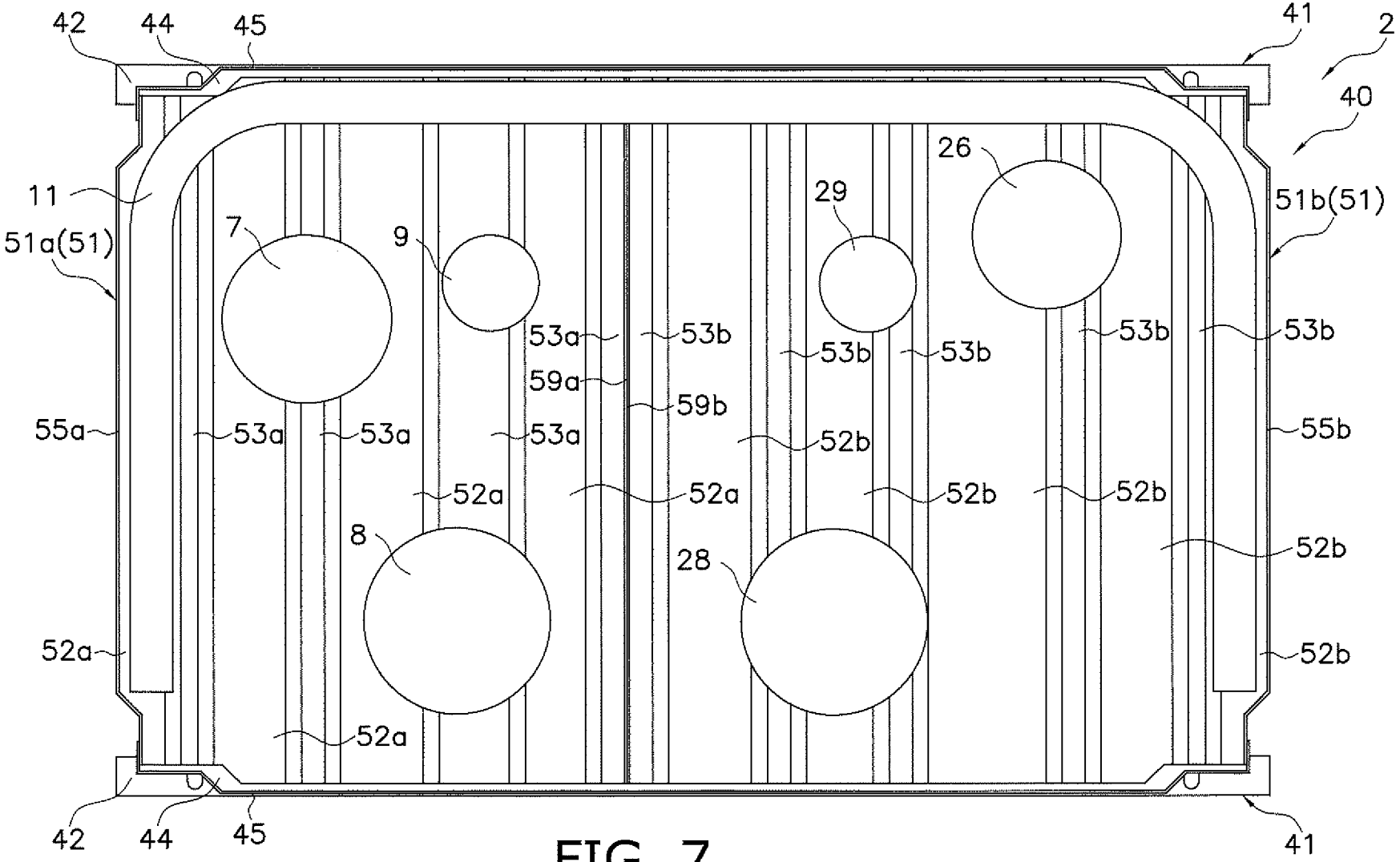
FIG. 7 is a plan view showing the bottom frame and the mounting feet in a case where capacity has been increased (showing only the general shapes of the accumulator, the compressor, the oil separator, the heat source-side heat exchanger, a second compressor, a second oil separator, and the receiver) according to one or more embodiments.

FIG. 2 is an external perspective view of the heat source unit 2. FIG. 3 is an exploded perspective view of the heat source unit 2 (showing only the general shapes of the accumulator 7, the compressor 8, the oil separator 9, and the heat source-side heat exchanger 11). FIG. 4 is a plan view showing a bottom frame 51 and mounting feet 41 (showing only the general shapes of the accumulator 7, the compressor 8, the oil separator 9, and the heat source-side heat exchanger 11). FIG. 5 is a general configuration diagram of the air conditioning system 1 (in a case where an injection function has been added). FIG. 6 is a plan view showing the bottom frame 51 and the mounting feet 41 in a case where the injection function has been added (showing only the general shapes of the accumulator 7, the compressor 8, the oil separator 9, the heat source-side heat exchanger 11, and a receiver 26). FIG. 7 is a plan view showing the bottom frame 51 and the mounting feet 41 in a case where capacity has been increased (showing only the general shapes of the accumulator 7, the compressor 8, the oil separator 9, the heat source-side heat exchanger 11, a second compressor 28, a second oil separator 29, and the receiver 26).

<Overall Structure>

The heat source unit 2 has what is called an upward-blowing structure that takes air into a casing 40 from below and blows the air out to the outside of the casing 40 from above. The heat source unit 2 mainly has the casing 40, which is shaped substantially like a rectangular parallelepiped box, the heat source-side fan 15, and refrigerant circuit constituent parts that configure part of the refrigerant circuit 6 and include the devices 7, 8, 9, and 11 such as the compressor and the heat source-side heat exchanger, the valves 10 and 12 to 14 such as the four-port switching valve and the heat source-side expansion valve, and the refrigerant pipes 16 to 24. It will be noted that in the following description, unless otherwise specified, "upper," "lower," "left," "right," "front," "rear," "front surface," and "back surface" will mean directions in a case where the heat source unit 2 shown in FIG. 2 is seen from the front (diagonally forward and to the left in the drawing).

The casing 40 mainly has a bottom frame 51 that bridges a pair of mounting feet 41 extending in the right and left direction, struts 61 that extend in the vertical direction from corner portions of the bottom frame 51, a fan module 71 that is attached to the upper ends of the struts 61, and a front surface panel 81.

The bottom frame 51 forms a bottom surface of the casing 40, and the heat source-side heat exchanger 11 is provided on the bottom frame 51. Here, the heat source-side heat exchanger 11 is a heat exchanger that is substantially U-shaped as seen in a plan view and faces the back surface and both right and left side surfaces of the casing 40, and substantially forms the back surface and both right and left side surfaces of the casing 40.

The fan module 71 is provided on the upper side of the heat source-side heat exchanger 11 and forms a top surface of the casing 40 and sections of the front surface, the back surface, and both right and left side surfaces of the casing 40 on the upper side of the struts 61. Here, the fan module 71 is a composite body where the heat source-side fan 15 and a bell mouth 72 are housed in a substantially rectangular parallelepiped box whose upper surface and lower surface are open, and an air outlet grille 73 is provided in the opening in the upper surface.

The front surface panel 81 bridges the struts 61 on the front surface side and forms a front surface of the casing 40.

Also housed inside the casing 40 are refrigerant circuit constituent parts other than the heat source-side fan 15 and the heat source-side heat exchanger 11 (FIG. 3 and FIG. 4 show the accumulator 7, the compressor 8, and the oil separator 9). Here, the compressor 8 is a device that compresses refrigerant and is provided on the bottom frame 51. Furthermore, the accumulator 7 is a refrigerant vessel that temporarily accumulates the refrigerant before the refrigerant is sucked into the compressor 8, and the accumulator 7 is provided on the bottom frame 51. The oil separator 9 is a device that separates refrigerating machine oil from the refrigerant after the refrigerant has been discharged from the compressor 8, and the oil separator 9 is provided on the bottom frame 51.

<Detailed Structure (Including Divided Structure of Bottom Frame 51 Considering Placement of Refrigerant Circuit Constituent Parts)>

The bottom frame 51 is a corrugated plate-like member in which ridge portions and furrow portions extending across the front and rear direction of the casing 40 are formed, and the bottom frame 51 has a first bottom frame 51*a* and a second bottom frame 51*b* that result from the bottom frame 51 being divided in two in the right and left direction. Here, the first bottom frame 51*a* configures the left portion of the bottom frame 51 when the casing 40 is viewed from the front surface side, and the first bottom frame 51*a* is a corrugated plate-like member in which ridge portions 52*a* and furrow portions 53*a* extending across the front and rear direction of the casing 40 are formed. The second bottom frame 51*b* configures the right portion of the bottom frame 51 when the casing 40 is viewed from the front surface side, and the second bottom frame 51*b* is a corrugated plate-like member in which ridge portions 52*b* and furrow portions 53*b* extending across the front and rear direction of the casing 40 are formed. The first bottom frame 51*a* and the second bottom frame 51*b* are placed side by side in the right and left direction when the casing 40 is viewed from the front surface side. The first bottom frame 51*a* and the second bottom frame 51*b* bridge the mounting feet 41. End portions of the first and second bottom frames 51*a* and 51*b* on sides (here, in the front and rear direction) where the ridge portions 52*a* and 52*b* and the furrow portions 53*a* and 53*b* can be seen are supported by the mounting feet 41. An outer wall portion 55*a* that extends upward beyond the ridge portions 52*a* and the furrow portions 53*a* is formed on the end portion of the first bottom frame 51*a* orthogonal (here, in the right and left direction) to the front and rear direction end portions of the first bottom frame 51*a* and on the side (here, the left side) distant from the second bottom frame 51*b*. A connecting wall portion 59*a* that borders the second bottom frame 51*b* is formed on the end portion of the first bottom frame 51*a* orthogonal (here, in the right and left direction) to the front and rear direction end portions of the first bottom frame 51*a* and on the side (here, the right side) close to the second bottom frame 51*b*. Furthermore, an outer wall portion 55*b* that extends upward beyond the ridge portions 52*b* and the furrow portions 53*b* is formed on the end portion of the second bottom frame 51*b* orthogonal (here, in the right and left direction) to the front and rear direction end portions of the second bottom frame 51*b* and on the side (here, the right side) distant from the first bottom frame 51*a*. A connecting wall portion 59*b* that borders the first bottom frame 51*a* is formed on the end portion of the second bottom frame 51*b* orthogonal (here, in the right and left direction) to the front and rear direction end portions of the second bottom frame 51*b* and on the side (here, the left side) close to the first bottom frame 51*a*. Additionally, in contrast to the right and left direction end portions of the first and second bottom frames 51*a* and 51*b*, outer wall portions are not formed on the front and rear direction end portions of the first and second bottom frames 51*a* and 51*b*, and so the shapes of the first and second bottom frames 51*a* and 51*b* are simplified.

Furthermore, here, the first bottom frame 51*a* and the second bottom frame 51*b* are configured to be corrugated plate-like members, so high-strength bottom frames 51*a* and 51*b* can be obtained. Moreover, here, the ridge portions 52*a* and 52*b* and the furrow portions 53*a* and 53*b* of the corrugated plate-like first bottom frame 51*a* and second bottom frame 51*b* are formed extending across the front and rear direction of the casing 40, so this is suited for placing the first bottom frame 51*a* and the second bottom frame 51*b* side by side to the left and right of each other when the casing 40 is viewed from the front surface side.

The mounting feet 41 are members that are substantially C-shaped as seen in a side view and extend in the right and left direction of the casing 40. The mounting feet 41 each mainly have an anchored portion 42 that becomes anchored to an installation surface, a vertical portion 43 that extends upward from an end portion of the anchored portion 42 on one side in the front and rear direction, and a support portion 44 that extends horizontally from the upper end portion of the vertical portion 43 toward the other side in the front and rear direction. The support portions 44 support the front and rear direction end portions of the first and second bottom frames 51*a* and 51*b* from below. Furthermore, the mounting feet 41 each have a wall portion 45 that extends upward from the end portion of the support portion 44 on the other side in the front and rear direction. The wall portions 45 are positioned on outer sides of the front and rear direction end portions of the first and second bottom frames 51*a* and 51*b*. That is, in the case of the mounting foot 41 placed on the front surface side of the casing 40, the wall portion 45 is positioned on the front side of the front and rear direction end portions of the first and second bottom frames 51*a* and 51*b*, and in the case of the mounting foot 41 placed on the back surface side of the casing 40, the wall portion 45 is positioned on the back surface side of the front and rear direction end portions of the first and second bottom frames 51*a* and 51*b*. Additionally, the wall portions 45 of the mounting feet 41 function as outer wall portions of the front and rear direction end portions of the first and second bottom frames 51*a* and 51*b*. That is, here, the wall portions 45 of the mounting feet 41 have the same function as the outer wall portions 55*a* and 55*b* of the right and left direction end portions of the first and second bottom frames 51*a* and 51*b*, while simplifying the shape of the first and second bottom frames 51*a* and 51*b*.

In the heat source unit 2 employing the bottom frame 51 with this divided structure, refrigerant circuit constituent parts such as the compressor 8 are provided, but at this time there are cases where the refrigerant circuit constituent parts are changed or added in accordance with capacity or function. In such cases, it is desired that questions such as on which of the divided bottom frames 51*a* and 51*b* are the refrigerant circuit constituent parts that are to be changed or added to be provided, and which bottom frame 51*a* or 51*b* is to be increased in size in order to provide the refrigerant circuit constituent parts that are to be changed or added, be considered, so that changing the size of the casing 40 and placing the refrigerant circuit constituent parts can be easily executed.

Therefore, here, as described above, the bottom frame 51 is divided in two (the first and second bottom frames 51*a* and 51*b*), and refrigerant circuit constituent parts that are common regardless of capacity or function (first refrigerant circuit constituent parts) are provided on one bottom frame (the first bottom frame 51*a*). Here, the first refrigerant circuit constituent parts are the refrigerant circuit constituent parts 7 to 10, 12 to 14, and 16 to 24 excluding the heat source-side heat exchanger 11 among the refrigerant circuit constituent parts 7 to 14 and 16 to 24 provided inside the casing 40. The first refrigerant circuit constituent parts are refrigerant circuit constituent parts that are the minimum needed to be provided inside the heat source unit 2 to configure to the air conditioning system 1 and are not changed even in a case where a change or addition is made to capacity or function. That is, the first refrigerant circuit constituent parts include the compressor 8 that compresses the refrigerant, the accumulator 7 that temporarily accumulates the refrigerant before the refrigerant is sucked into the compressor 8, and the oil separator 9 that separates the refrigerating machine oil from the refrigerant after the refrigerant has been discharged from the compressor 8. Furthermore, refrigerant circuit constituent parts that are changed or added depending on capacity or function (second refrigerant circuit constituent parts) are provided on the other bottom frame (the second bottom frame 51*b*). Here, a second refrigerant circuit constituent part among the above-described refrigerant circuit constituent parts is the heat source-side heat exchanger 11 that functions as a radiator or an evaporator of the refrigerant and is provided extending across both the first bottom frame 51*a* and the second bottom frame 51*b*. The heat source-side heat exchanger 11 is included in the second refrigerant circuit constituent parts because sometimes its size is changed in order to change the heat exchange capacity when executing a capacity change as described later. It will be noted that, in FIG. 4, the heat source-side heat exchanger 11 is set to a size suited to the first refrigerant circuit constituent parts, and in accompaniment with this, the size of the second bottom frame 51*b* is also set to a size with which the heat source-side heat exchanger 11 can be placed in the entire bottom frame 51.

Additionally, by employing this structure, the placement of the refrigerant circuit constituent parts (i.e., the first refrigerant circuit constituent parts) and the size of the casing 40 on the first bottom frame 51*a* side can be spared from being changed regardless of whether or not the refrigerant circuit constituent parts (i.e., the second refrigerant circuit constituent parts) are changed or added in accordance with capacity or function. Moreover, it suffices to change just the placement of the refrigerant circuit constituent parts (i.e., the second refrigerant circuit constituent parts) and/or the size of the casing 40 on the second bottom frame 51*b* side. Because of this, here, when the size of the casing 40 is changed as a result of the refrigerant circuit constituent parts being changed or added in accordance with capacity or function, changing the size of the casing 40 and placing the refrigerant circuit constituent parts can be easily executed.

For example, in the configuration having the basic refrigerant circuit 6 shown in FIG. 1, there are cases where one wants to make a change in or addition to the refrigerant circuit constituent parts configuring the refrigerant circuit 6 to add a function for enhancing performance or the like. As a specific example, as shown in FIG. 5, there are cases where one connects a receiver 26 to the refrigerant pipe 23 inside the heat source unit 2 and connects a degassing pipe 27, which removes gas refrigerant from the upper portion of the receiver 26, to add the function of executing gas injection to the compressor 8. That is, the receiver 26 and the degassing pipe 27 are added as second refrigerant circuit constituent parts.

With respect to such changing or adding of the second refrigerant circuit constituent parts (here, mainly adding the receiver 26 and the degassing pipe 27), here, as shown in FIG. 6, the receiver 26 is provided on the second bottom frame 51*b*, the refrigerant pipe 23 (not shown in FIG. 6) is connected to the receiver 26, and the degassing pipe 27 (not shown in FIG. 6) is connected to the receiver 26 and the compressor 8.

In this way, here, the receiver 26 and the degassing pipe 27 are provided on the second bottom frame 51*b*, so the gas injection function can be easily added without changing the placement of the first refrigerant circuit constituent parts such as the compressor 8 provided on the first bottom frame 51*a*. Furthermore, here, the receiver 26 serving as a refrigerant circuit constituent part (a second refrigerant circuit constituent part) that is changed or added in accordance with capacity or function is provided on the second bottom frame 51*b*, but the receiver 26 is lighter in weight compared to the first refrigerant circuit constituent parts including the compressor 8 and the accumulator 7 provided on the first bottom frame 51*a*. For this reason, here, the first bottom frame 51*a* is configured to have a larger plate thickness than the second bottom frame 51*b*. Because of this, here, the strength of the first bottom frame 51*a* can be increased and the weight of the second bottom frame 51*b* can be reduced.

Furthermore, for example, in the configuration having the basic refrigerant circuit 6 shown in FIG. 1, there are cases where one wants to make a change in or addition to the refrigerant circuit constituent parts configuring the refrigerant circuit 6. As a specific example, there are cases where one executes a capacity change that provides, together with a second oil separator, a second compressor connected in parallel to the first compressor 8 to increase the operating capacity of the compressor and, in accordance therewith, increases the size of the heat source-side heat exchanger 11. That is, the second compressor and the second oil separator are added as second refrigerant circuit constituent parts and the size of the heat source-side heat exchanger 11 serving as a second refrigerant circuit constituent part is changed.

With respect to such changing or adding of the second refrigerant circuit constituent parts (here, mainly adding a second compressor 28 and a second oil separator 29 and changing the size of the heat source-side heat exchanger 11), here, as shown in FIG. 7, the second compressor 28 and the second oil separator 29 are provided on the second bottom frame 51*b* and connected in parallel to the first compressor 8, the size of the heat source-side heat exchanger 11 is increased, and the size of the second bottom frame 51*b* is increased.

In this way, here, the size of the second bottom frame 51*b* is changed in response to providing the second compressor 28 and the second oil separator 29 on the second bottom frame 51*b* and changing the size of the heat source-side heat exchanger 11, so a capacity change can be easily executed without changing the placement of the first refrigerant circuit constituent parts such as the compressor 8 provided on the first bottom frame 51*a*. Furthermore, here, the heat source-side heat exchanger 11 is provided along an edge portion of the bottom frame 51, so by changing the length of the edge portion of the second bottom frame 51*b*, the size of the heat source-side heat exchanger 11 serving as a second refrigerant circuit constituent part can be easily changed.

Furthermore, in the heat source unit 2, there is the concern that refrigerant pipes connected to the compressor 8 and area devices (the compressor 8, the accumulator 7, and the oil separator 9) will sustain damage from vibrations during operation and during transport, so to ensure that such damage does not occur, the placement of these devices and the placement and shapes of the refrigerant pipes connected to these devices are appropriately set. For this reason, even in a case where the refrigerant circuit constituent parts are changed or added in accordance with capacity or function, the placement of these devices and the placement and shapes of the refrigerant pipes connected to these devices should be spared from being changed. With respect to this, here, the compressor 8 and area devices (the compressor 8, the accumulator 7, and the oil separator 9) are collectively placed as the first refrigerant circuit constituent parts on the first bottom frame 51*a*. Because of this, here, even in a case where the refrigerant circuit constituent parts are changed or added in accordance with capacity or function, the compressor 8, the accumulator 7, and the oil separator 9 and the placement and shapes of the refrigerant pipes connected to these devices can be spared from being changed. Furthermore, the size of the first bottom frame 51*a* and the refrigerant circuit constituent parts provided on the first bottom frame 51*a* (i.e., the first refrigerant circuit constituent parts) are not changed, so simulation predictions for evaluating vibration and noise performance can be easily executed.

Furthermore, here, the ridge portions 52*a* and 52*b* and the furrow portions 53*a* and 53*b* of the corrugated plate-like first bottom frame 51*a* and second bottom frame 51*b* are formed extending across the front and rear direction of the casing 40, so the first bottom frame 51*a* and the second bottom frame 51*b* can be placed side by side to the left and right of each other, when the casing 40 is viewed from the front surface side, to change the size of the casing 40. It will be noted that although there are many cases where, when installing the heat source unit 2, there are restrictions on the size of the casing 40 in the front and rear direction, here, the first bottom frame 51*a* and the second bottom frame 51*b* can be placed side by side to the left and right of each other to change the size of the casing 40, so the heat source unit 2 can be spared from being subjected to restrictions on the size of the casing 40 in the front and rear direction.

(3) Example Modifications

<A>

In the aforementioned embodiments, the first bottom frame 51*a* configures the left portion of the bottom surface of the casing 40 and the second bottom frame 51*b* configures the right portion of the bottom surface of the casing 40, but the first bottom frame 51*a* and the second bottom frame 51*b* are not limited to this and may also be switched in the right and left direction.

<B>

In the aforementioned embodiments, cases where a gas injection function is added and the capacity is changed to increase were given as cases where the refrigerant circuit constituent parts are changed or added in accordance with capacity or function, but the invention is not limited to this and can also be applied to other cases where functions are added and the capacity is changed.

Although the disclosure has been described with respect to only a limited number of embodiments, those skill in the art, having benefit of this disclosure, will appreciate that various other embodiments may be devised without departing from the scope of the present invention. Accordingly, the scope of the invention should be limited only by the attached claims.

INDUSTRIAL APPLICABILITY

The present invention is widely applicable to a heat source unit where refrigerant circuit constituent parts are provided inside a casing.

REFERENCE SIGNS LIST

2 Heat Source Unit
7 Accumulator
8 Compressor
9 Oil Separator
40 Casing
51 Bottom Frame
51*a* First Bottom Frame
51*b* Second Bottom Frame
52*a*, 52*b* Ridge Portions
53*a*, 53*b* Furrow Portions

CITATION LIST

Patent Literature

Patent Document 1: JP-A No. 2011-158137

The invention claimed is:

1. A heat source unit that constitutes part of a basic refrigerant circuit, the heat source unit comprising:

a casing comprising a bottom plate that forms a bottom surface of the casing;

first refrigerant circuit constituent parts comprising:

a first compressor that compresses refrigerant;

an accumulator that temporarily accumulates the refrigerant before the refrigerant is sucked into the first compressor; and a first oil separator that separates refrigerating machine oil from the refrigerant after the refrigerant has been discharged from the first compressor, wherein the basic refrigerant circuit comprises:

the first refrigerant circuit constituent parts;

a liquid refrigerant communication pipe;

utilization-side expansion valves;

utilization-side heat exchangers; and a gas refrigerant communication pipe, wherein the first refrigerant circuit constituent parts, the liquid refrigerant communication pipe, the utilization-side expansion valves, the utilization-side heat exchangers, and the gas refrigerant communication pipe are connected to one another, wherein the first refrigerant circuit constituent parts are provided inside the casing, wherein the heat source unit further comprises:

second refrigerant circuit constituent parts that are sized based on a capacity of the heat source unit and that include at least one of:

a heat source side heat exchanger;

a second compressor; and a second oil separator; and wherein the bottom plate is configurable in a first state and a second state and comprises:

a first bottom plate portion on which the first refrigerant circuit constituent parts are provided; and a second bottom plate portion having a first size or a third bottom plate portion having a second size different from the first size when viewed in a plan view, wherein one of the second bottom plate portion and the third bottom plate portion is disposed side by side with the first bottom plate portion, wherein in the first state where the second refrigerant circuit constituent parts comprise the heat source side heat exchanger but does not comprise the second compressor and the second oil separator, the bottom plate comprises the first bottom plate portion and the second bottom plate portion and the second refrigerant circuit constituent parts are directly disposed on the second bottom plate portion, wherein in the second state where the second refrigerant circuit constituent parts comprise at least one of the second compressor and the second oil separator, the bottom plate comprises the first bottom plate portion and the third bottom plate portion and the second refrigerant circuit constituent parts are directly disposed on the third bottom plate portion.

2. The heat source unit according to claim 1, wherein the first bottom plate portion and the second bottom plate portion are corrugated plates each comprising ridge portions and furrow portions extending in a front and rear direction of the casing.

3. The heat source unit according to claim 1, further comprising:

a pair of mounting feet extending in a direction in which the first bottom plate portion and the second bottom plate portion are arranged, wherein the first bottom plate portion and either the second bottom plate portion or the third bottom plate portion are supported by the pair of mounting feet.

4. The heat source unit according to claim 1, wherein the second refrigerant circuit constituent parts further comprise a heat source-side heat exchanger that functions as a radiator or an evaporator of the refrigerant, and the heat source-side heat exchanger extends across both the first bottom plate portion and the second bottom plate portion.

5. The heat source unit according to claim 4, wherein the first bottom plate portion and the second bottom plate portion are corrugated plates each comprising ridge portions and furrow portions extending in a front and rear direction of the casing.

6. The heat source unit according to claim 1, wherein the first bottom plate portion has a larger thickness than the second bottom plate portion.

7. The heat source unit according to claim 6, wherein the first bottom plate portion and the second bottom plate portion are corrugated plates each comprising ridge portions and furrow portions extending in a front and rear direction of the casing.

8. The heat source unit according to claim 6, wherein the second refrigerant circuit constituent parts further comprise a heat source-side heat exchanger that functions as a radiator or an evaporator of the refrigerant, and the heat source-side heat exchanger extends across both the first bottom plate portion and the second bottom plate portion.

9. The heat source unit according to claim 8, wherein the first bottom plate portion and the second bottom plate portion are corrugated plates each comprising ridge portions and furrow portions extending in a front and rear direction of the casing.

* * * * *